US005971199A

United States Patent [19]

Jackson et al.

[11] Patent Number: 5,971,199

[45] Date of Patent: Oct. 26, 1999

[54] SOIL SEPARATION APPARATUS

[75] Inventors: Ronald C. Jackson, Wyoming; Robert D. Faber, Grand Rapids; Donald W. Bushman, Caledonia, all of Mich.

[73] Assignee: Amway Corporation, Ada, Mich.

[21] Appl. No.: 09/005,971

[22] Filed: Jan. 12, 1998

[51] Int. Cl.[6] ..... A46B 17/00

[52] U.S. Cl. ..... 220/608; 15/264

[58] Field of Search ..... 220/607, 608, 220/571; 15/264

[56] References Cited

U.S. PATENT DOCUMENTS

| | | | |
|---|---|---|---|
| 3,485,434 | 12/1969 | Donovan et al. | 220/608 X |
| 3,751,746 | 8/1973 | Elbreder . | |
| 4,161,799 | 7/1979 | Sorrells . | |
| 4,577,775 | 3/1986 | Kresin | 220/608 X |
| 4,878,264 | 11/1989 | Young . | |
| 5,183,179 | 2/1993 | Morris, Sr. | 220/608 X |
| 5,687,444 | 11/1997 | Hakker | 220/608 X |

*Primary Examiner*—Steven Pollard
*Attorney, Agent, or Firm*—Brinks Hofer Gilson & Lione; G. Peter Nichols

[57] ABSTRACT

Soil separation apparatus includes a container, such as a bucket, from which cleaning liquid is taken and to which that liquid is returned after is has been used for dirt removal. The container is provided with a soil separator. The separator has at least one associated projection and depression, and preferably, a plurality of associated projections and depressions. The separator is positioned in the container to receive dirt settling under gravity from the contained liquid and, in particular, onto the depressions. The form and structure of the separator is such that disturbance of the liquid in the container does not wash the collected dirt back out into the main body of liquid to a significant extent.

17 Claims, 4 Drawing Sheets

SOIL SEPARATION APPARATUS

BACKGROUND OF THE INVENTION

The present invention relates to cleaning equipment in which cleaning liquid is taken from a container and returned to the container after the liquid has been used for cleaning. The present invention is particularly useful for a cleaning bucket for use with a cleaning element or device such as a floor mop, cleaning sponge, scrubbing pad, and the like, that is repeatedly wrung out into the bucket. In particular, the present invention relates to a separator effective for separating particulate soil from the main body of liquid in a container and maintaining the separated soil from the main body of liquid even while the main body of liquid is being disturbed.

A problem with known cleaning equipment is that dirt deposited out from the cleaning liquid collects at the bottom of the container but is redistributed into the main body of liquid when the liquid is disturbed by, for example, rinsing out a mop or sponge. Consequently, the cleaning element, such as the mop or sponge, picks up the redistributed dirt allowing it to be redeposited onto the clean surface, and potentially scratching many types of scrubbed surfaces. Moreover, the container is often emptied and cleaned out before the cleaning constituents of the liquid are actually exhausted.

Several solutions have been proposed for these problems. For example, U.S. Pat. No. 4,161,799 proposes a partition that is particularly useful for a mop cleaning device. The partition divides the container into side-by-side compartments with the expectation that the dirt or soil remain in one compartment while the other compartment is substantially dirt or soil-free. This proposed solution, however, is bulky, complicated, and not suitable for home consumer use.

Another proposed solution can be found in U.S. Pat. No. 4,878,264 where the bottom of a bucket is provided with a dirt trap. The trap includes a mat or pad-like form that receives dirt settling under gravity and traps the dirt below the element. The trap is described as a porous, cellular, or mesh-like structure, or as a molded rubber or plastic having passages such as corkscrew passages. This structure allows dirt to pass through and/or be trapped within the mesh or passages. In addition, the top of the mat is provided with an array of spaced fronds or strands that will float and stand up when there is no disturbance of the liquid but will lie flat when disturbance is considerable to seal of the top of the mat to protect the dirt from disturbance. While this solution may be effective, it would appear to be prohibitively expensive to manufacture for all but industrial use.

Thus, there still exists a need for an inexpensive yet effective apparatus capable of separating dirt or soil from the main body of liquid in a container and maintaining the separated dirt or soil from the main body of liquid even when the main body of liquid is being disturbed.

SUMMARY OF THE INVENTION

In accordance with the present invention, the cleaning equipment comprises a container provided with a soil separator that is positioned in the container, preferably in the bottom of the container, to receive dirt settling under gravity from the main portion of the contained liquid with the dirt collecting on at least a portion of the separator, the form and structure of the separator being such that disturbance of the liquid in the container does not wash the collected dirt back out into the main portion of the liquid to a significant extent. The separator may be integral with the container or may be separate.

The container can have any shape suitable for containing liquids that may be dictated by manufacturing, cost, aesthetic, as well as other considerations. Typically, however, the container will be a bucket generally having a cylindrical or rectangular cross-section. Such buckets are well known and are typically manufactured from plastics. In one preferred embodiment, the container is a rectangular bucket such as a 3–4 gallon rectangular bucket manufactured by Rubbermaid.

The separator can have any suitable three-dimensional structure provided two essential requirements are met. First, dirt must be able to settle by gravity onto at least a portion of the separator. Second, the deposited dirt cannot then be washed back into the main body of liquid to a significant extent as a result of disturbances in the main body of liquid. With those two requirements in mind, the separator generally has a top and a bottom surface. The top surface has at least one projection extending upward so that when the separator is positioned in the container to receive dirt settling under gravity from the contained liquid, disturbance of the liquid in the container does not wash the collected dirt back out to any significant extent.

In a preferred embodiment, the separator has a plurality of projections extending upward from the top surface of the separator with the projections desirably being spaced apart to define depressions or troughs. Without being bound by any particular theory, it is believed that the dirt settling by gravity preferentially settles into the depressions, and when the liquid is disturbed, the projections baffle or deaden the disturbance so that the settled dirt does not wash back out to the main body of liquid to a significant extent. Preferably, the projections are semi-rigid or rigid so that they do not deform during disturbance of the main liquid.

In addition, the projection has a height less than the overall height of the container. Preferably, the projection has a height that is less than one-half the overall height of the container. Advantageously, in this embodiment, the container will have a substantial portion of liquid substantially free from dirt. In a preferred embodiment, the ratio of the height of the projection to the height of the bucket is from about 1:10 to about 1:4.

The projection(s) may have any suitable shape so long as the two above-described essential requirements are met. For example, the projection may have a shape selected from the group consisting of triangular, conical, square, rectangular, elliptical, cylindrical, circular, polyhedral, pyramidal, rhombic, sinusoidal wave, and modifications of those general shapes. Each projection may be the same or different. Generally, it is desired to form the separator from a rigid material and thus, the exact shape of the projection may be dictated in part by manufacturing considerations. For example, it may be desired to mold the separator from plastic so that it is compatible with the container. It will be appreciated by one of skill in the art that the shape of the projections may be somewhat rounded to account for molding considerations.

In a preferred embodiment, the separator and container are integrally molded so that the bottom of the separator is contiguous with the inside bottom of the container. In this preferred embodiment, each projection has substantially the same overall shape and height. In one preferred embodiment, the projection has a pyramidal shape wherein two of the opposing sides are longer than the other two opposing sides. In this preferred embodiment, where a plurality of projections are provided, at least some of the projections may be aligned so that the longer of the two opposing sides lie in parallel planes. Desirably, a first group of aligned projections are arrayed in relation to a second group of aligned projections such that the first group is perpendicular to the second group. The first and second group of aligned projections may be arrayed in alternating fashion about the periphery of the container and may be arrayed in alternating fashion along either a lateral or a longitudinal axis, or both. It has been found that this structure is very effective in reducing the amount of settled dirt from washing back out to the main body of liquid.

The term "main body of liquid" or "main portion of liquid" as used in the specification and appended claims refers to that portion of liquid within the container that is above the height of the projection(s). It is within this portion of the container that the user will typically rinse the cleaning device (e.g. mop, sponge, scrubbing pad, cloth, etc.) and agitate or disturb the liquid.

DETAILED DESCRIPTION OF THE INVENTION

Figure 1:
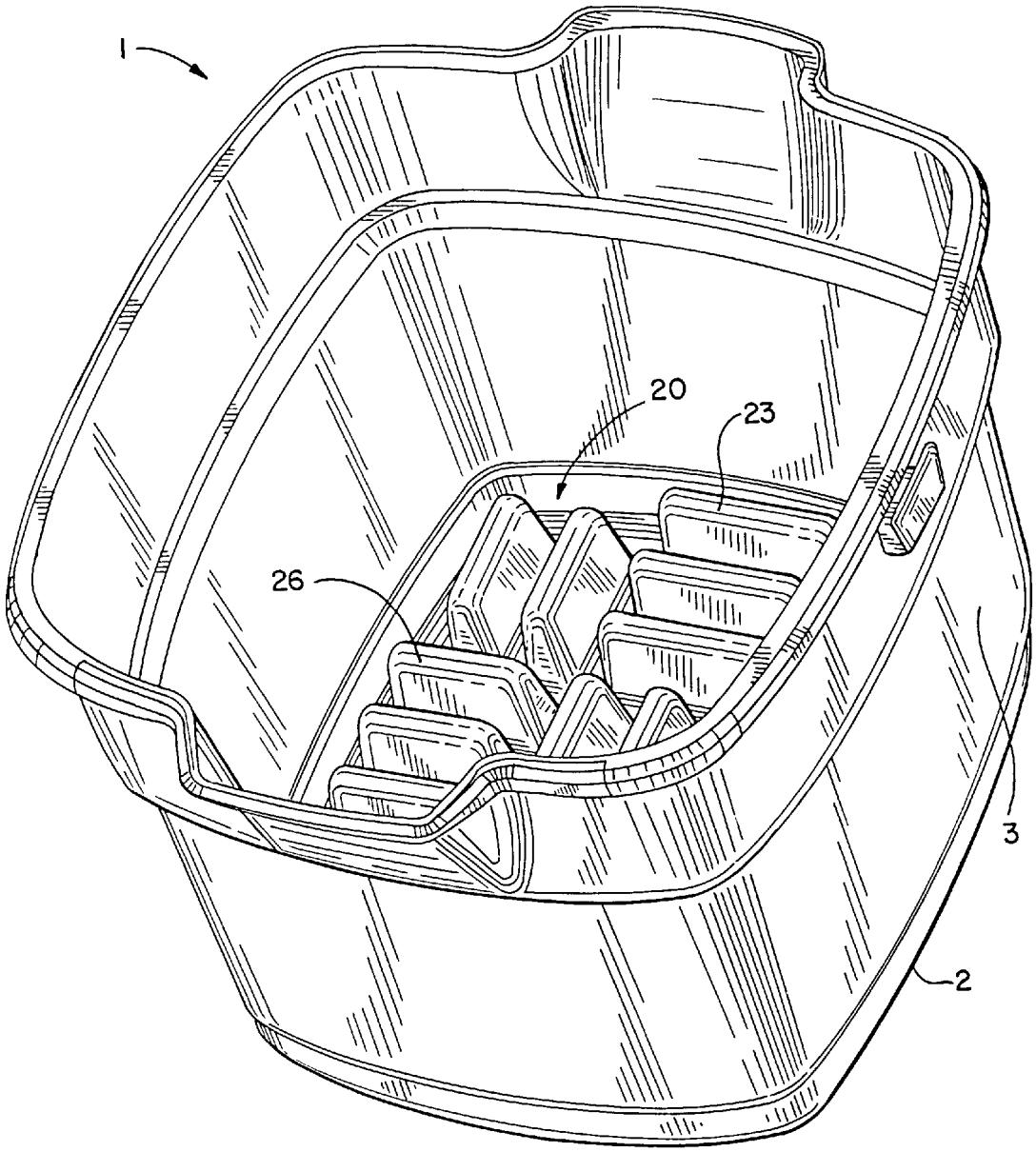
FIG. 1 is a perspective view of one embodiment of a container having a soil separator according to the present invention.
Figure 4:
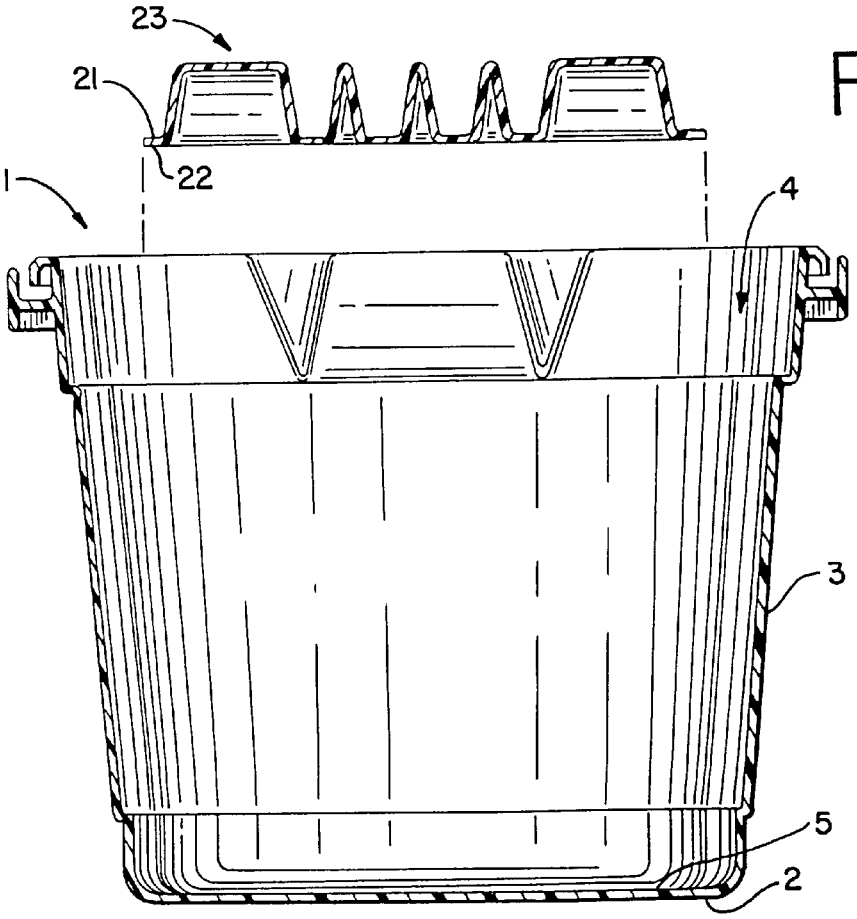
FIG. 4 is a cross-sectional view of the container of FIG. 2 representing another embodiment of the present invention where the separator is separate from the container.
Figure 5A:
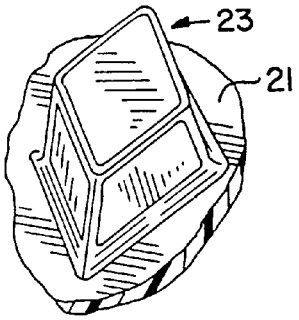
FIGS. 5A–5G show several suitable shapes that may be included in the separator of the present invention. Each of the shapes may be used alone, in conjunction with others, and/or modified to provide any suitable shape consistent with the objectives of the present invention.
Figure 5B:
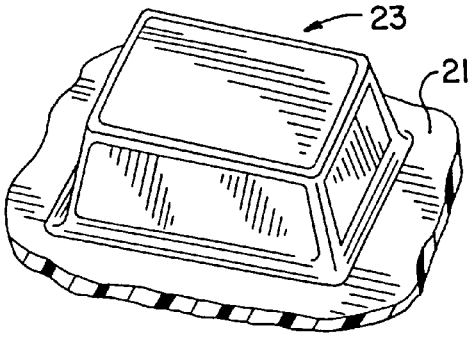
Figure 5C:
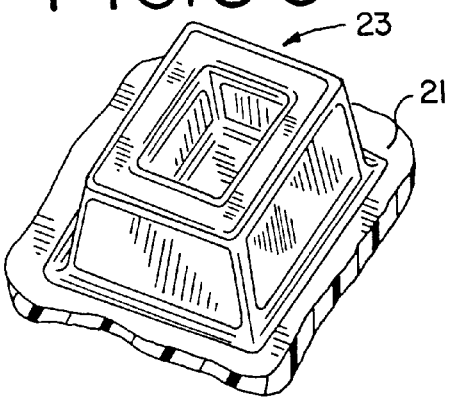
Figure 5D:
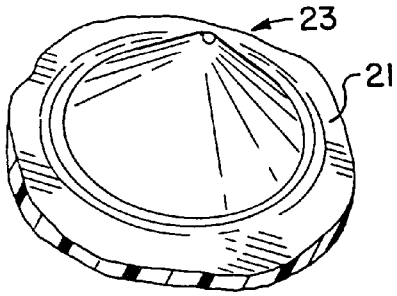
Figure 5E:
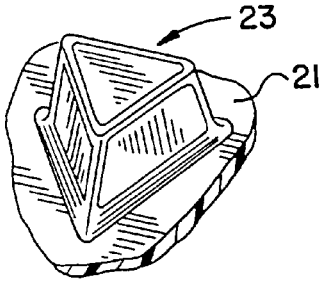
Figure 5F:
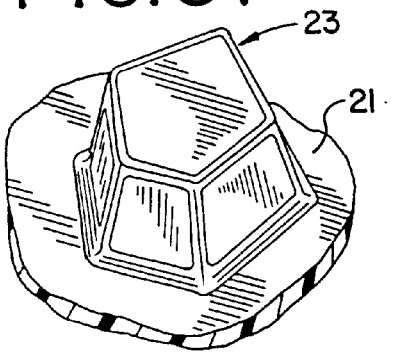
Figure 5G:
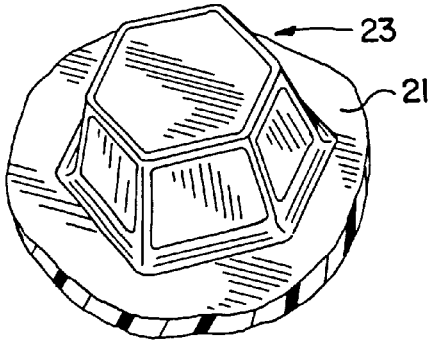

Referring now to FIG. 1, a bucket 1 is shown that when in use contains a cleaning liquid for use in a cleaning operation. The cleaning liquid includes a main portion, which is generally the area of liquid above the separator 20. The bucket includes a bottom 2 and an upstanding wall or walls 3 to define an interior 4 of the bucket and an inside of the bottom 5 (best seen in FIG. 4). As is well known, the bucket may be provided with a handle (not shown) or other device so that the bucket may be easily transported.

The separator 20 is positioned on the inside of the bottom and preferably covers the whole area of the inside of the bottom of the container. The separator has a top surface 21 and a bottom surface 22 (best seen in FIGS. 3 and 4). The top surface of the separator has at least one and preferably a plurality of projections 23.

The projection may have any suitable shape so long as the desired requirements of the container are met. FIGS. 5A–5G show various suitable shapes of the projection. Each of the projections may be the same or different. In addition each of the projections shown may be used alone, combined with other shapes, and/or modified.

Figure 3:
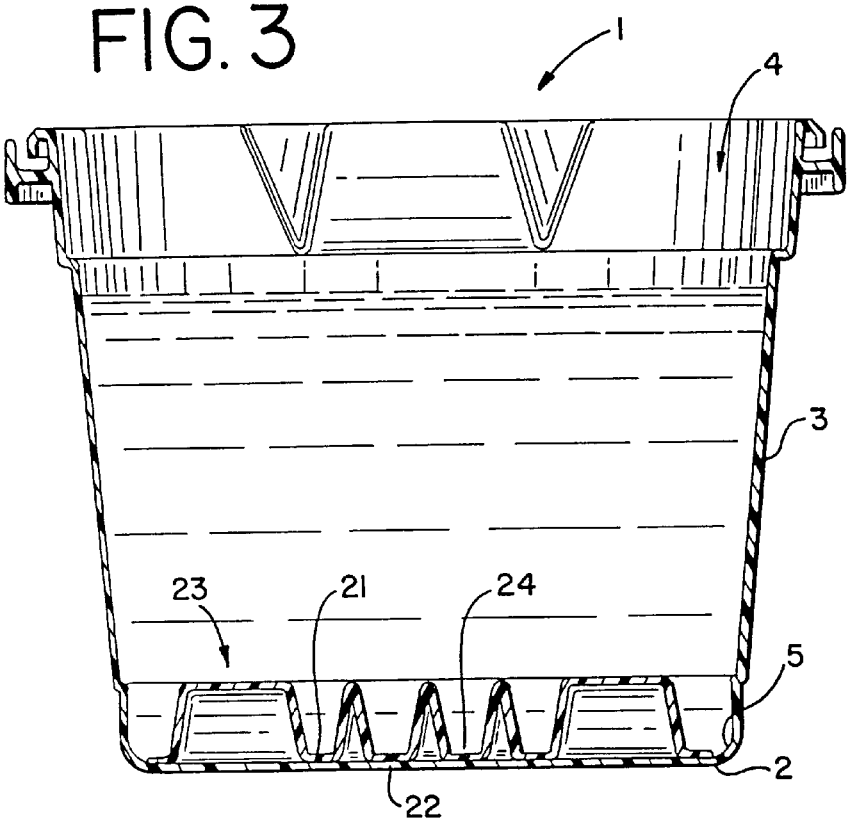
FIG. 3 is cross-sectional view of the container of FIG. 2 along line 3—3 representing one embodiment where the separator is integral with the container.

In one embodiment, best seen in FIG. 3, the separator is removable from the bucket and, when the separator is positioned in the bucket, the bottom surface of the separator may rest on the inside of the bottom of the bucket. Alternatively, the separator may be designed to leave a gap at the bottom or it may even be allowed to float within the container. The separator in this embodiment may be formed from a solid rigid material such as metal or molded plastic. Alternatively, the separator may be formed from a solid semi-rigid material such as foam and the like. Similarly, although the separator can be formed from a solid rigid material, it may be provided with passages, either linear or non-linear.

The projections are preferably shaped and spaced from each other to define a number of depressions or troughs 24. The projections have a height that is less than the overall height of the container. Preferably, the projections have a height that is less than about one-half the overall height of the container. In this case, when the separator is placed on the inside bottom of the container, the main portion of liquid will comprise at least one-half of the volume of the container. Desirably, the projections have a height such that the ratio of the height of the projections to the overall height of the container is from about 1:10 to about 1:4, more preferably from about 1:8 to about 1:5.

In a preferred embodiment of the present invention, the container is a rectangular bucket, such as a 3–4 gallon rectangular bucket manufactured by Rubbermaid. As best seen in FIG. 3, the container is molded from plastic and in this embodiment, the separator is integrally molded with the container so that the separator is molded on the inside bottom of the container. Thus, in this embodiment, the inside bottom of the bucket and the bottom surface of the separator are the same or contiguous.

The separator is solid, rigid plastic and has a plurality of projections 23 extending upward from the top surface 21. The projections are spaced apart to define depressions 24. In this preferred embodiment, the projections are somewhat pyramidal shaped and have four sides 25*a*, 25*b*, 25*c*, and 25*d*. Two opposing sides 25*a* and 25*c* are longer than the other two opposing sides 25*b* and 25*d*. The sides may be joined at rounded or square corners. Each of the sides converge at the top 26, which in this embodiment is rounded.

Figure 2:
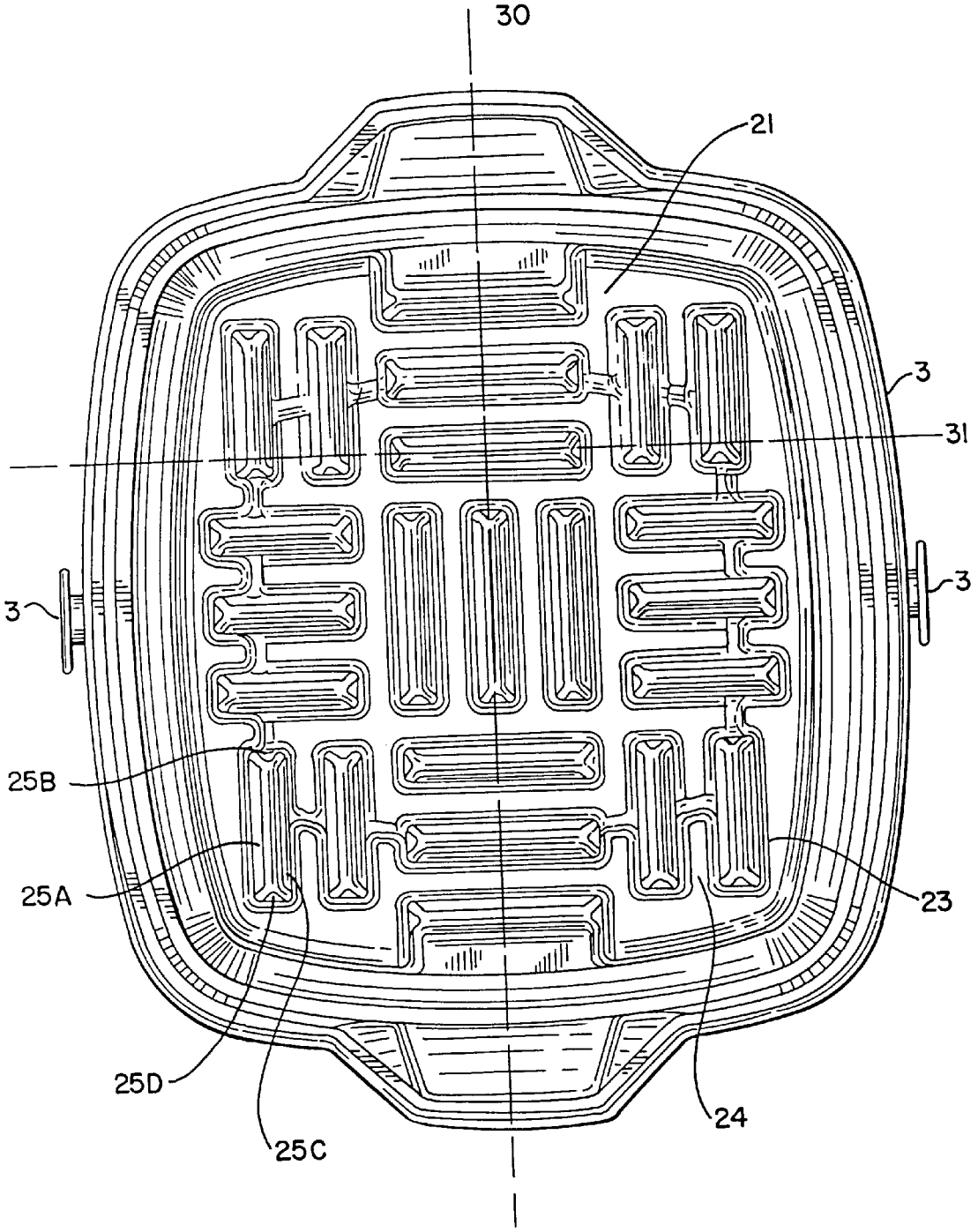
FIG. 2 is a top view of the container of FIG. 1.

As best seen in FIG. 2, the container may be considered to have a longitudinal axis 30 and a lateral axis 31. At least some of the projections have two of their opposing sides, for example 25*a* and 25*c*, aligned in parallel planes. In addition, it will be appreciated that a first group of projections have two of their opposing sides in parallel planes that are also parallel with the lateral axis. This first group of projections are normal to a second group of projections that have two of their opposing sides in parallel planes that are also parallel with the longitudinal axis. In a particularly preferred embodiment, the first and second groups of projections are arrayed in an alternating fashion along either the longitudinal axis, the lateral axis, or most preferably along both axes. When arrayed in this manner, it can also be seen that the first and second groups are in an alternating fashion about the inner periphery of the container.

It should be understood that a wide range of changes and modifications can be made to the embodiments described above. It will also be readily appreciated that the cleaning equipment of the present invention may be used for all types of cleaning operations such as window cleaning, wall washing, vehicle cleaning, cleaning of articles generally, floor cleaning, and the like. It is therefore intended that the foregoing description illustrates rather than limits this invention, and that it is the following claims, including all equivalents, which define this invention.

What is claimed:

1. Soil separation apparatus comprising:

a. a container having a height to contain a liquid; and b. a soil separator having a top surface and a bottom surface, wherein the top surface is provided with a plurality of projections having rounded edges rounded-blunt upper ends, and a height less than one-half of the height of the container, the separator being positioned in the container to receive dirt settling under gravity from the contained liquid with the form and structure of the separator being such that disturbance of the liquid in the container does not wash the collected dirt back out to any significant extent, wherein the contained liquid is above the height of the projections.

2. The apparatus of claim 1, wherein the container is a bucket suitable for use with a hand-held cleaning element or device.

3. The apparatus of claim 1, wherein the projection is rigid.

4. The apparatus of claim 1, wherein the projections are spaced from each other to define depressions.

5. The apparatus of claim 4 wherein each projection is the same and has a general pyramidal shape with first opposing sides having a first width and second opposing sides having a second width such that the first width is smaller than the second width.

6. The apparatus of claim 5, wherein the second opposing sides of at least some of the projections are substantially aligned in parallel planes.

7. The apparatus of claim 6, wherein substantially aligned projections define a first group of projections and wherein the second opposing sides of at least some other projections are substantially aligned in parallel planes to define a second group of projections wherein the second opposing sides of the second group of projections are perpendicular to the second opposing sides of the first group.

8. The apparatus of claim 7 wherein the container has a bottom and a continuous wall extending upward from the bottom to define an inside of the container, and wherein the first group of projections and the second group of projections are located in alternating fashion about the inside periphery of the container.

9. The apparatus of claim 8 wherein a ratio of the height of each of the projections to the height of the container is from about 1:10 to about 1:4.

10. The apparatus of claim 9 wherein the contained liquid has a height of at least one-half the height of the container.

11. The apppartus of claim 9, wherein each projection has substantially the same height.

12. The apparatus of claim 1 wherein each projection has a shape selected from the group consisting of triangular, conical, square, rectangular, elliptical, cylindrical, circular, polyhedral, pyramidal, rhombic, and sinusoidal wave, and wherein each projection may be the same or different.

13. The apparatus of claim 1, wherein the separator is integrally formed with the inside bottom surface.

14. A soil separation apparatus comprising:

a. a bucket for containing liquid, the bucket comprising a bottom and at least one upstanding wall to define an interior of the bucket and a container height; and b. a soil separator integrally molded with the bottom of the bucket such that the wall surrounds the separator, the separator comprising a plurality of spaced apart rigid projections having rounded edges, rounded-blunt upper ends, and a height less that one-fourth the container height, the projections defining a plurality of spaced apart depression such that the depressions receive dirt settling under gravity from the contained liquid and does not wash back out to any significant extent, wherein the contained liquid is above the height of the projections.

15. The apparatus of claim 14 wherein each projection has a height less than one-half the height of the container.

16. The apparatus of claim 1, wherein the container has a bottom and a wall surrounding the bottom of define an inside bottom surface, and wherein the separator is located on the inside bottom surface.

17. The apparatus of claim 8 wherein the depressions define at least one continuous channel along one or more of a lateral and a longitudinal axis.

* * * * *

UNITED STATES PATENT AND TRADEMARK OFFICE

CERTIFICATE OF CORRECTION

PATENT NO. : 5,971,199
DATED : October 26, 1999
INVENTOR(S) : Ronald C. Jackson et al.

It is certified that error appears in the above-identified patent and that said Letters Patent is hereby corrected as shown below:

Claim 11,
Line 1, delete "appartus of claim 9" and substitute -- apparatus of claim 1 -- in its place.

Claim 16,
Line 2, delete "of" and substitute -- to -- in its place.

Signed and Sealed this

Eighteenth Day of September, 2001

*Attest:*

Nicholas P. Godici

NICHOLAS P. GODICI
*Acting Director of the United States Patent and Trademark Office*

*Attesting Officer*